US005749407A

United States Patent [19]

Brenner et al.

[11] Patent Number: 5,749,407

[45] Date of Patent: May 12, 1998

[54] FOLDING GARAGE DOOR WITH REINFORCING STRUTS

[75] Inventors: Richard A. Brenner, Winston-Salem, N.C.; Dennis Romanelli, Pompano Beach, Fla.

[73] Assignees: Amarr Company, Winston-Salem, N.C.; RBI, Inc., Pompano Beach, Fla.

[21] Appl. No.: 819,340

[22] Filed: Mar. 18, 1997

[51] Int. Cl.[6] ..... E06B 3/48

[52] U.S. Cl. ..... 160/229.1; 160/201

[58] Field of Search ..... 160/201, 196.1, 160/199, 206, 207, 213, 405, 229.1; 52/291, 739.1, 264, 236.3

[56] References Cited

U.S. PATENT DOCUMENTS

| | | | |
|---|---|---|---|
| 2,196,399 | 4/1940 | Rubel . | |
| 2,863,503 | 12/1958 | Stroup | 160/201 |
| 2,966,212 | 12/1960 | Fimbel | 160/201 X |
| 3,010,547 | 11/1961 | Foster . | |
| 3,180,460 | 4/1965 | Liskey, Jr. . | |
| 3,443,625 | 5/1969 | Moser et al. . | |
| 3,516,474 | 6/1970 | Pemberton et al. . | |
| 3,608,613 | 9/1971 | Halliwell | 160/201 X |
| 3,740,916 | 6/1973 | Kenaga | 160/201 X |
| 3,891,021 | 6/1975 | Geoffrey | 160/201 X |
| 3,910,003 | 10/1975 | Jerila | 52/739.1 X |
| 4,378,043 | 3/1983 | Sorenson | 160/201 X |
| 4,385,476 | 5/1983 | Slager | 52/739.1 |
| 4,934,439 | 6/1990 | Martin | 160/201 |
| 4,982,545 | 1/1991 | Stromback . | |
| 5,588,270 | 12/1996 | Keating | 160/201 X |

*Primary Examiner*—David M. Purol
*Attorney, Agent, or Firm*—Richard C. Litman

[57] ABSTRACT

A folding garage door with specially shaped reinforcing struts fastened in a horizontal position to the rear of the door for strengthening the folding garage door against strong positive and negative wind pressures.

10 Claims, 2 Drawing Sheets

FOLDING GARAGE DOOR WITH REINFORCING STRUTS

BACKGROUND OF THE INVENTION

1. Field of the Invention

The present invention relates to a folding garage door reinforced with a series of unique door struts fastened on the rear of the folding garage door at strategic locations to prevent damage to the garage door and the vehicles stored, inside the garage from strong positive and negative wind pressures and to assure that the door will meet local wind code requirements.

2. Description of Prior Art

The prior art describes various reinforcing elements for trusses, garage doors, flooring and the like, but fail to show a folding garage door strut positioned horizontally and having the cross-sectional shape of the present invention. The prior art will be discussed in the order of their perceived relevance to the present invention.

U.S. Pat. No. 3,443,625 issued on May 13, 1969, to Lester W. Moser et al. describes a reinforced collapsible door having a centered vertical post member which is reticulated with one stationary upper channel member connected by a cap to a series of lower stationary channel members connected further by caps. The cap has an outer sidewall with lipped flanges, but covers the lower channel member which also has inwardly directed lipped flanges. There is no suggestion for adding horizontal reinforcement members.

U.S. Pat. No. 3,180,460 issued on Apr. 27, 1965, to Ernest C. Liskey, Jr. describes an inverted aluminum floor panel stringer or girder having a cross-section with a channel on its upper surface and inwardly directed lipped flanges at its bottom. There is no suggestion for modifying the direction of the lipped flanges to an outward direction.

U.S. Pat. No. 4,982,545 issued on Jan. 8, 1991, to Gustav M. Stromback describes a steel roof truss for spanning large areas made from chord members spliced with smaller members. Each top chord unit has a cross-sectional top hat shape with rolled flanges on the outer edge of each leg, and reinforcing ridges in the legs and rolled in reinforcing ribs in the base. The legs must have a length twice the width of the base width. 14–20 gauge metal is utilized for the truss. FIG. 1 depicts the upper chord units of the truss with the flanges not abutting the load bearing roof structure. FIG. 3 shows that the flanges can be rolled flat against the legs. The web members in FIG. 4 have no outward flanges. There is no suggestion to utilize the roof truss elements for reinforcing a folding garage door and fastened in the manner of the present invention.

U.S. Pat. No. 3,516,474 issued on Jun. 23, 1970, to Paul E. Pemberton et al. describes a door brace structure for a folding garage door. Horizontal brace members are fastened behind each folding panel. These brace members can be made of light gauge aluminum, steel or fiberglass. The brace members have a channel with outwardly projecting coplanar flanges which are secured to the door. A centrally located vertical cable is provided to fasten to the garage floor, extend up against the horizontal brace members, and attach to an eyebolt in the ceiling header. The cross-sectional configuration of the brace member is different, and the brace members require the structural assistance of the cable in anticipation of only a positive wind pressure. The rationale for the inventive structure is based on transferring the positive wind force through the cable to the header and the floor of the building. The present invention is concerned with negative wind pressure as well as positive wind pressure. Furthermore, the cable is utilized only in anticipation of wind damage.

U.S. Pat. No. 2,196,399 issued on Apr. 9, 1940, to Max J. Rubel, describes a steel enclosed cubical switchboard structure made by welding column members, cross members, and spacing members. Each structural member may have various cross-sections that are U-shaped and with or without flanges. The flanges may be folded outwardly or inwardly and even be joined. There is no suggestion for the shape of the reinforcing strut of the present invention.

U.S. Pat. No. 3,010,547 issued on Nov. 28, 1961, to David B. Foster describes a prefabricated building having extruded aluminum structural members with at least 13 different cross-sectional shapes. None of these cross-sectional shapes suggest the shape of the reinforcing struts of the present invention.

None of the above inventions and patents, taken either singularly or in combination, is seen to describe the instant invention as claimed. Thus, a durable folding garage door reinforced with struts of the present invention solving the aforementioned problems is desired.

SUMMARY OF THE INVENTION

The present invention provides an economical solution to damage from sudden wind forces exerting positive and negative pressures on a garage door, especially of the folding overhead type. A series of reinforcing struts having a structurally different cross-section of the present invention are fastened horizontally across the rear surface of a folding garage door at spaced locations. The cross-section of a reinforcing strut comprises a battlement shaped top surface including a crenel separating a pair of merlons. Each sidewall extending from the merlons are perpendicular and have an outwardly directed flange ending in a lip parallel to each sidewall. The flanges are fastened to the rear of the folding garage door.

Accordingly, it is a principal object of the invention to provide a folding garage door with specially shaped reinforcing struts, and a method of strengthening a folding door by attaching a series of reinforcing struts horizontally to the rear of the folding garage door.

It is another object of the invention to provide a reinforcement strut having a cross-section shaped on a top surface as a battlement with a crenel between merlons.

It is a further object of the invention to provide a reinforcement strut having base flanges with lips.

It is yet another object of the invention to provide a garage door reinforcement system which protects against sudden strong positive and negative wind pressures.

It is an object of the invention to provide improved elements and arrangements thereof in a reinforcing strut for a folding garage door for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
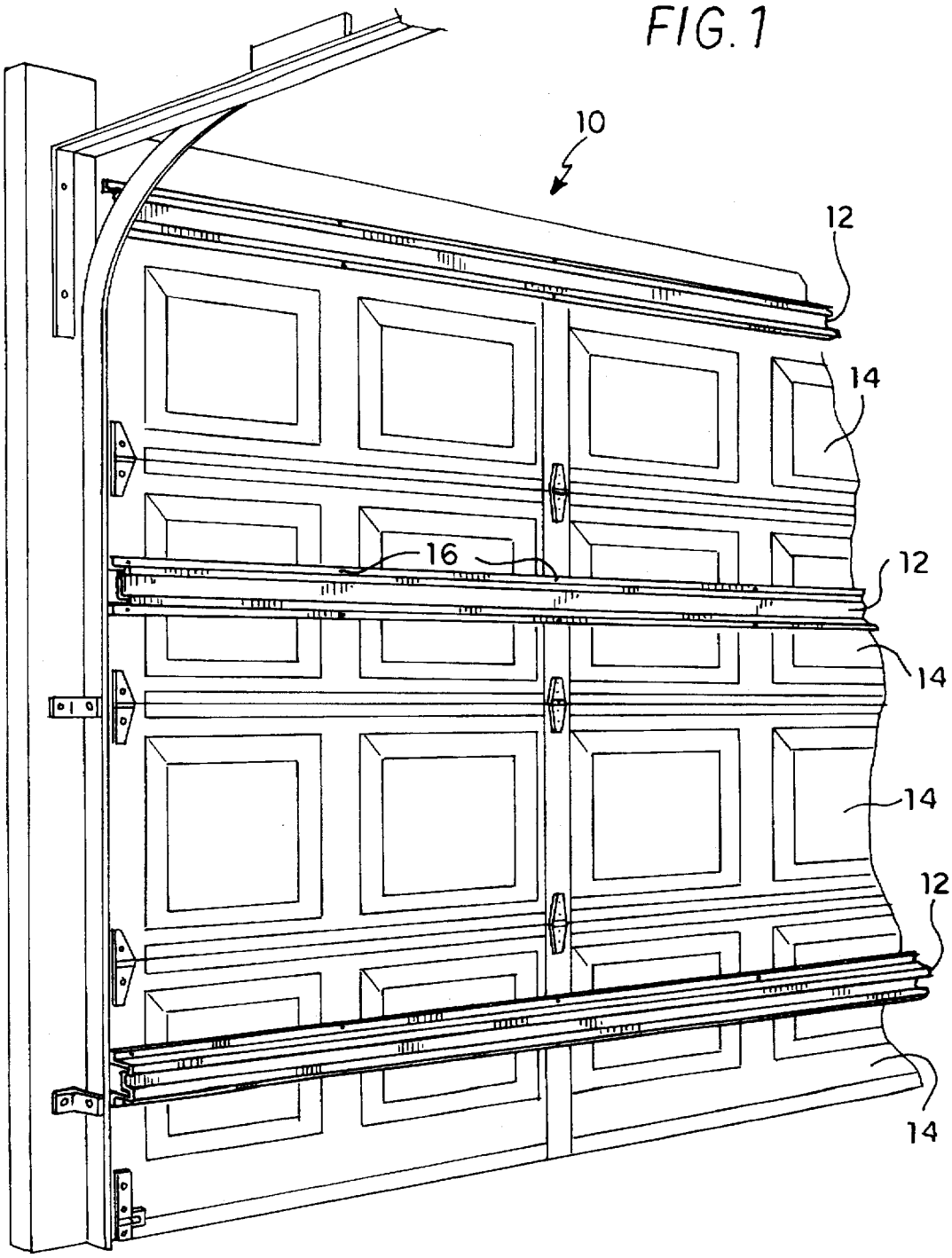
FIG. 1 is an environmental and partial perspective view of the rear of a folding garage door with reinforcing struts according to the present invention.

In FIG. 1, the present invention provides the rear surface of a folding garage door 10 with at least three reinforcing strut members 12 spaced at strategic positions such as at the top and at several median positions of a folding door segment or panel 14 as illustrated. The horizontal struts 12 have a length extending from one side of the door 10 to the opposite side. The struts 12 are fastened to the door 10 by fasteners 16 such as self-tapping screws. Struts 12 are preferably made from 18 to 22 gauge galvanized steel with a height from 3" to 6".

Figure 2:
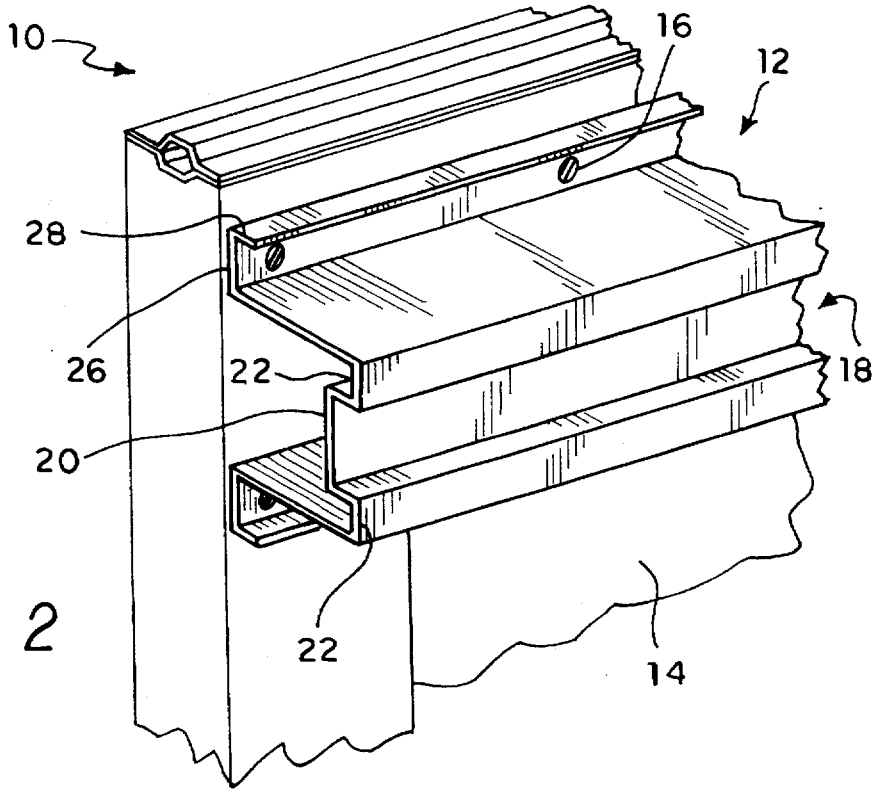
FIG. 2 is a partial perspective view of a reinforcing strut of the present invention installed in the top right-hand corner of the folding garage door.

FIG. 2 depicts a reinforcing strut 12 fastened adjacent to the top of the folding garage door 10 with fasteners 16.

Figure 3:
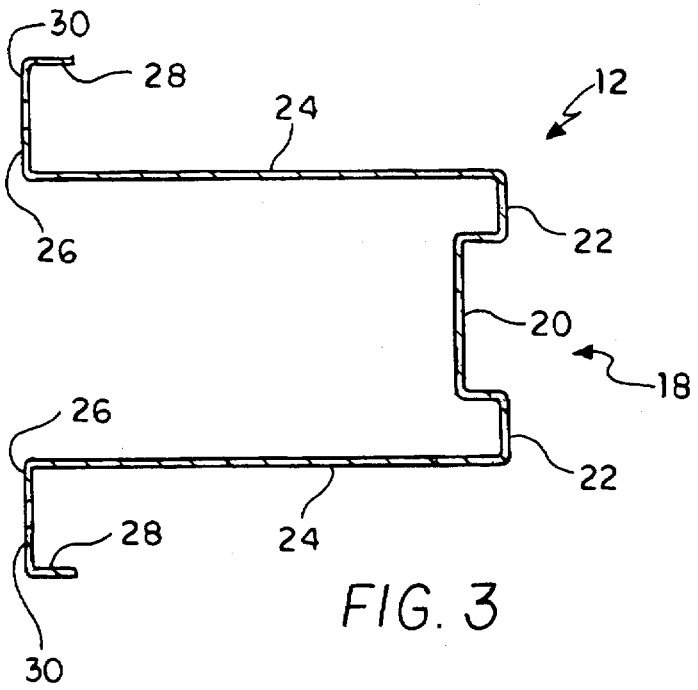
FIG. 3 is cross-sectional view of a reinforcing strut.

FIG. 3 illustrates the inventive cross-sectional shape of the horizontal strut 12 best described in terms of the familiar top outline of a battlement 18 of fortresses of old. A grooved portion at the top is described as a crenel 20. The crenelated portion is located between two merlons 22. The width of a merlon 22 is preferably approximately half the width of a crenel 20. The height of each battlement 18 is at least twice the width of the battlement. A sidewall 24 extends perpendicularly from the outside edge of each merlon 22 and terminates in an outwardly disposed base flange 26. Each base flange ends with a perpendicular lip portion 28 which is parallel to a sidewall 24. At the ends of the strut 12 and at predetermined intervals, fasteners 16 (not shown) are attached to secure the strut 12 to the folding garage door 10 in the apertures 30 shown in each base flange 26.

The battlement structure 18 of the reinforcing strut 12 has been found to be effective under actual testing in resisting both positive and negative wind forces of the strength expected in regions of the country most affected by damaging windstorms.

It is to be understood that the present invention is not limited to sole embodiment described above, but encompasses any and all embodiments within the scope of the following claims.

We claim:

1. A reinforcing strut for a garage door, said strut comprising:

a battlement shaped top including a crenel between two merlons;

flat sidewalls extending perpendicularly from each merlon;

each sidewall having a base flange outwardly disposed therefrom; and each flange having a lip portion parallel to said sidewall, said strut having a strut length for reinforcing a width of a garage door; whereby a series of garage door struts are adapted to be fastened horizontally across the rear of said garage door to protect against wind damage due to extreme sudden positive and negative pressures.

2. The garage door strut according to claim 1, wherein the width of a merlon is approximately half the width of said crenel.

3. The garage door strut according to claim 1, wherein the height of said battlement shaped top surface is at least twice the width of the battlement.

4. The reinforcing strut according to claim 1, wherein each said base flange is adapted to be fastened to the rear of said garage door with folding panels.

5. A method of strengthening a folding garage door comprising:

attaching struts horizontally across the rear face of multiple folding garage door panels at spaced locations;

providing said struts with a cross-sectional shape of a battlement with merlons separated by a crenel and a sidewall perpendicular to each said merlon, each said sidewall further having a flange extending outwardly with a lip extending parallel to each said sidewall; and providing fasteners to fasten each flange to the rear of the folding garage door; whereby said folding garage door is protected against wind damage due to extreme sudden positive and negative pressures.

6. A reinforced folding garage door with horizontal struts comprising:

a folding garage door;

horizontal reinforcing struts spaced from top to bottom and fastened across the rear of said folding garage door; and each reinforcing strut comprising:

a battlement shaped top including a crenel between two merlons;

flat sidewalls extending perpendicularly from each merlon;

each sidewall having a base flange outwardly disposed; and each flange having a lip portion parallel to said sidewall;

said struts having a strut length commensurate with a width of said garage door;

whereby a series of garage door struts are fastened horizontally across the rear of said garage door to protect against wind damage due to extreme sudden positive and negative pressures; said garage door having no other reinforcing structure.

7. The reinforced folding garage door according to claim 6, wherein the width of a merlon is approximately half the width of said crenel.

8. The reinforced folding garage door according to claim 6, wherein the height of said battlement shaped top surface is at least twice the width of the battlement.

9. The reinforced folding garage door according to claim 6, wherein the base flanges are fastened to the rear of the garage door.

10. The reinforced folding garage door according to claim 6, wherein the garage door has horizontal folding panels.

* * * * *